US012782073B2

(12) United States Patent
Yu et al.

(10) Patent No.: US 12,782,073 B2
(45) Date of Patent: Nov. 3, 2026

(54) STORAGE AND LOADING SYSTEM FOR LARGE CALIBER AMMUNITION

(71) Applicant: Meggitt Defense Systems, Inc., Irvine, CA (US)

(72) Inventors: Dino Yu, Irvine, CA (US); Derek Q. Young, San Clemente, CA (US)

(73) Assignee: Meggitt Defense Systems, Inc., Irvine, CA (US)

( * ) Notice: Subject to any disclaimer, the term of this patent is extended or adjusted under 35 U.S.C. 154(b) by 0 days.

(21) Appl. No.: 19/199,592

(22) Filed: May 6, 2025

(65) Prior Publication Data

US 2025/0264286 A1 Aug. 21, 2025

Related U.S. Application Data

(63) Continuation of application No. 18/348,086, filed on Jul. 6, 2023, now Pat. No. 12,313,368.

(60) Provisional application No. 63/489,589, filed on Mar. 10, 2023.

(51) Int. Cl.
*F41A 9/79* (2006.01)
*F41A 9/42* (2006.01)

(52) U.S. Cl.
CPC . *F41A 9/79* (2013.01); *F41A 9/42* (2013.01)

(58) Field of Classification Search
CPC ..... F41A 9/04; F41A 9/05; F41A 9/09; F41A 9/42; F41A 9/61; F41A 9/76
USPC ..... 89/33.01, 33.05
See application file for complete search history.

(56) References Cited

U.S. PATENT DOCUMENTS

| | | | |
|---|---|---|---|
| 3,670,863 | A | 6/1972 | Meier |
| 3,720,301 | A | 3/1973 | Garland |
| 4,064,787 | A | 12/1977 | Eklund |
| 4,313,363 | A | 2/1982 | Schreckenberg |
| 4,632,011 | A | 12/1986 | Metz |
| 4,941,393 | A | 7/1990 | Dodd |
| 5,151,556 | A | 9/1992 | Maher |

(Continued)

FOREIGN PATENT DOCUMENTS

| | | |
|---|---|---|
| DE | 2948146 C2 | 3/1993 |
| WO | 0125713 A1 | 4/2001 |

OTHER PUBLICATIONS

Patent Cooperation Treaty, International Search Report and Written Opinion for International Application No. PCT/US2024/018393, dated Sep. 17, 2024, 9 pages.

*Primary Examiner* — Bret Hayes
(74) *Attorney, Agent, or Firm* — Stetina Garred Brucker & Newboles

(57) ABSTRACT

A magazine for large ammunition includes a plurality of ammunition holders, with each ammunition holder being configured to operatively interface with a single round of ammunition. Each ammunition holder comprises an outer body, and an inner body configured to interface with the single round of ammunition. The inner body is transitional relative to the outer body between a first position and a second position, with the inner body extending out of the outer body as the inner body transitions from the first position toward the second position. The inner body is configured to release the single round of ammunition in response to the inner body being transitioned to the second position. The magazine additionally includes a plurality of links, with each link being coupled to a pair of the plurality of ammunition holders.

20 Claims, 12 Drawing Sheets

(56) References Cited

U.S. PATENT DOCUMENTS

| | | | | | |
|---|---|---|---|---|---|
| 5,175,388 | A | * | 12/1992 | Maher | F41A 9/04 89/35.01 |
| 5,212,338 | A | * | 5/1993 | Maher | F41A 9/76 89/33.14 |
| 5,223,663 | A | * | 6/1993 | Bender-Zanoni | F41A 9/82 89/46 |
| 5,347,908 | A | | 9/1994 | Mouterde | |
| 5,353,679 | A | | 10/1994 | Nordmann | |
| 5,456,154 | A | | 10/1995 | Golden | |
| 5,594,192 | A | | 1/1997 | Rodriguez | |
| 5,675,109 | A | * | 10/1997 | Maher | F41A 9/73 89/46 |
| 11,268,775 | B2 | | 3/2022 | Blache | |
| 12,313,368 | B2 | * | 5/2025 | Yu | F41A 9/79 |
| 2022/0357119 | A1 | | 11/2022 | Yu | |

* cited by examiner

STORAGE AND LOADING SYSTEM FOR LARGE CALIBER AMMUNITION

CROSS-REFERENCE TO RELATED APPLICATIONS

This application is a continuation of U.S. patent application Ser. No. 18/348,086, filed Jul. 6, 2023, which claims the benefit of U.S. Provisional Application No. 63/489,589, filed Mar. 10, 2023, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a storage and loading system for large caliber ammunition rounds for the main gun of a main battle tank.

2. Description of the Related Art

Historically, loading of large sized ammunition, typically for 90 mm size and above, for a main battle tank, was performed manually. Personnel within the tank will remove ammunition intended to be loaded from stationary ammunition storage racks and place it into the main gun. More recently in some applications, automated loading and storage devices (together commonly referred to as Autoloaders), have been incorporated to eliminate the man from the loading task.

The configurations of Autoloaders varied widely. Since the loading and storage devices must work in conjunction with each other, the method of operation of one is heavily dependent on the method of operation of the other. Some storage devices (referred to as Magazines) store ammunition in the rear bustle area with the ammunition pointing forward, while some store the ammunition pointing aft. Other Magazines store ammunition inside the turret with the ammunition pointing down, while some would point the ammunition up. The ammunition conveyance and storage means of these Magazines were typically moving shells or tubes. The Magazines typically cycle the selected ammunition within these storage shells/tubes to an interface location with the loading device (referred to as the Loader). Where upon the Loader can then remove the ammunition from the storage device and transport the ammunition to load it into the main gun.

In addition to the ability to store and transport ammunition, these Autoloader systems typically have many means of controlling the ammunition during the ammunition's storage, transition, and transport throughout the complete loading cycle. These ammunition control means can be latches, clamps, gates, doors, etc. Further, these ammunition control means may have with them additional motors, solenoids, and other needed method of electrical/hydraulic actuation. The disadvantage of these additional motors, solenoids, etc. is that they must be controlled and thus must have their function completion detected. The actuation time of these control means and the detection of the completion of the control means adds time to the cycle and thus reduces the total firing rate of the main gun.

One important aspect of ammunition loading is the speed at which consecutive rounds can be loaded and fired in a short amount of time, i.e., the firing rate needed is high. Depending on the configuration and layout of the Autoloader system due to space and other factors, the firing rate might be compromised to meet system design trade off and demands.

In view of the foregoing, there is a need for an ammunition autoloader that minimizes the quantity of electrical/hydraulic actuated mechanism such that the firing rate is increased and the volume necessary for the ammunition is kept to a minimum. Various aspects of the present disclosure address this particular need, as will be discussed in more detail below.

BRIEF SUMMARY

In accordance with one embodiment of the present disclosure, there is provided a magazine for large ammunition. The magazine includes a plurality of ammunition holders, with each ammunition holder being configured to operatively interface with a single round of ammunition. Each ammunition holder comprises an outer body, and an inner body configured to interface with the single round of ammunition. The inner body is transitional relative to the outer body between a first position and a second position, with the inner body extending out of the outer body as the inner body transitions from the first position toward the second position. The inner body is configured to release the single round of ammunition in response to the inner body being transitioned to the second position. The magazine additionally includes a plurality of links, with each link being coupled to a pair of the plurality of ammunition holders.

The magazine may additionally include a first wall and a second wall in spaced relation to the first wall. The plurality of ammunition holders may be located between the first and second walls. The first wall may include an opening formed therein, with the opening being sized to allow one of the inner bodies to extend therethrough as the inner body transitions from the first position and the second position. The first wall may be configured to restrict transition of the inner body from the first position toward the second position to only when the inner body is coaxially aligned with the opening.

Each inner body may include a main portion and at least one ammunition engagement portion moveable relative to the main portion to facilitate release of the single round of ammunition. A leaf spring may be operatively coupled to a corresponding one of the at least one ammunition engagement portion to bias the at least one ammunition engagement portion in a prescribed direction.

The magazine may additionally include comprising a track in operative communication with the plurality of links, with the track being configured to guide the links along a prescribed path during operation of the magazine.

The magazine may also comprise a rammer head moveable relative to the plurality of ammunition holders between a retracted position and an actuated (e.g., extended) position. The rammer head may be configured to selectively engage an ammunition round and advance the ammunition round axially through the inner body toward a gun barrel as the rammer head moves from the retracted position towards the actuated position. The rammer head may be configured to engage an ammunition round and retract the ammunition round through the inner body away from a gun barrel as the rammer head moves from the actuated position towards the retracted position. The rammer head and inner body may be configured to be independently moveable along a common axis. The rammer head may include a plurality of fingers configured to engage an ammunition round. The rammer head may additionally include a plurality of finger supports, with the plurality of fingers being pivotally coupled to respective ones of the plurality of finger supports. The rammer head may define a central axis, with the plurality of finger supports being spaced about the central axis. Each finger may be pivotable between a first position and a second position and moving radially outward as the finger pivots from the first position toward the second position. Each finger may be biased towards the second position. The inner body and the plurality of fingers may be configured such that interaction between the inner body and the plurality of fingers causes the plurality of fingers to transition from the second position toward the first position to engage with an ammunition round. The magazine may also include a chain coupled to the rammer head.

The plurality of ammunition holders may be configured to be disposable along at least three parallel axes.

Each link may include a first rim defining a first opening sized to receive a first one of the plurality of ammunition holders, and a second rim coupled to the first rim and defining a second opening sized to receive a second one of the plurality of ammunition holders.

According to another embodiment, there is provided a magazine for large ammunition. The magazine comprises a plurality of ammunition holders moveable along a magazine track, with each ammunition holder being configured to operatively interface with a single round of ammunition. The plurality of ammunition holders are operatively linked to each other such that a first group of the plurality of ammunition holders reside on a first axis, a second group of the plurality of ammunition holders reside on a second axis, and a third group of the plurality of ammunition holders reside on a third axis, with the plurality of ammunition holders translating along the first axis as the plurality of ammunition holders move along the magazine track.

The plurality of ammunition holders may be configured such that a first pair of the plurality of ammunition holders are operatively linked to each other such that they are both aligned with the first axis during a portion of the movement of the first pair along the magazine track. The first pair of the plurality of ammunition holders may be operatively linked to each other such that one of the first pair of ammunition holders resides on the second axis while the other of the first pair of ammunition holders resides on the third axis. The first pair of the plurality of ammunition holders may be operatively linked to each other such that one of the first pair of ammunition holders translates along the second axis while the other of the first pair of ammunition holders translates along the third axis.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a magazine holder for large sized ammunition, and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 1:
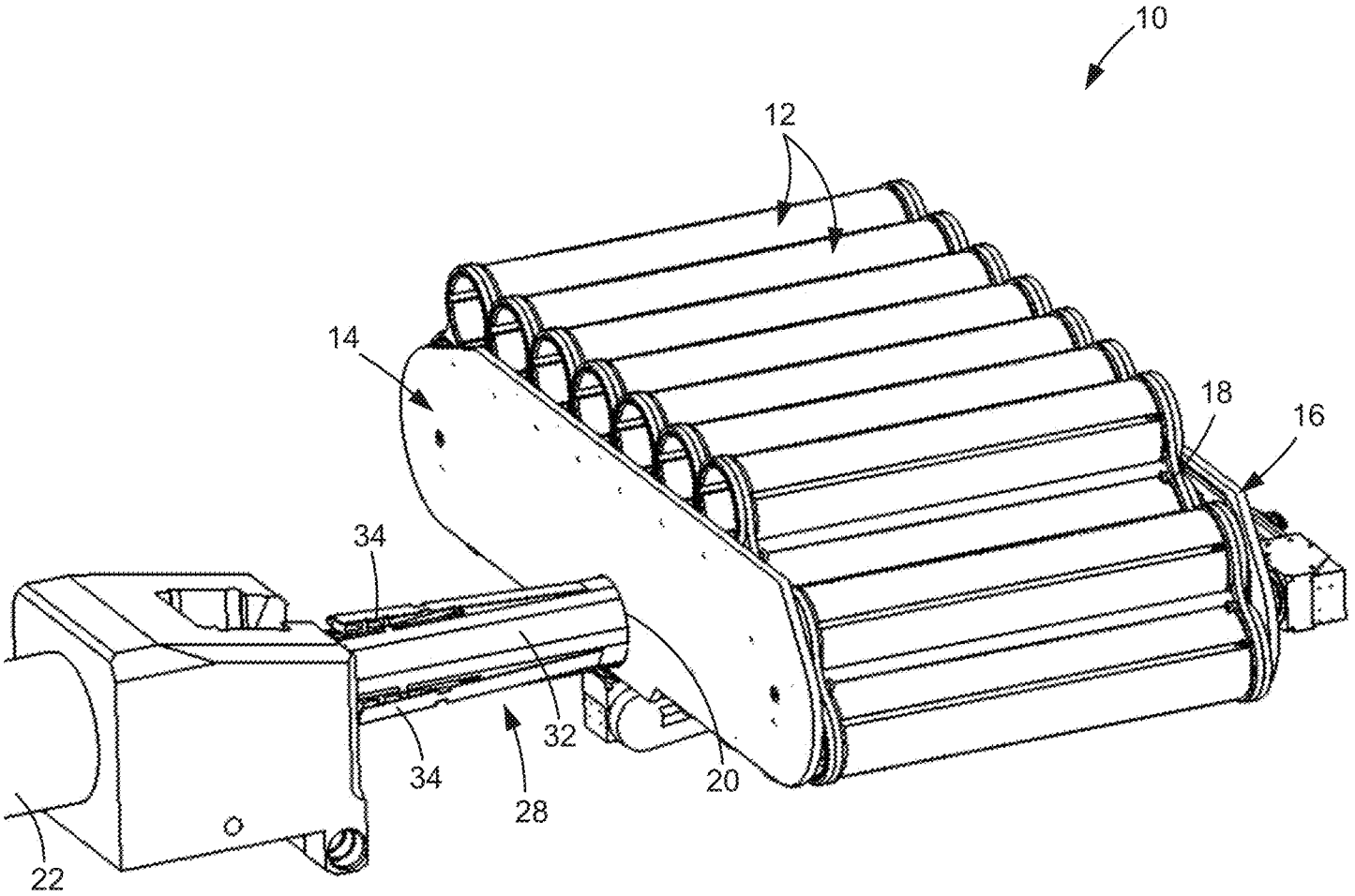
FIG. 1 is an upper perspective view of a magazine for large ammunition, the magazine being shown with an inner tube of an ammunition holder being in an extended position.

Various aspects of the present disclosure pertain to a magazine for ammunition, with particular suitability for large ammunition, e.g., ammunition that is 90 mm and above. Referring now specifically to FIG. 1, there is depicted a magazine 10 specifically configured and adapted for use with storing and feeding large ammunition to the barrel of a gun. The magazine 10 may be capable of loading and firing consecutive ammunition rounds at high speed, particularly relative to conventional firing speeds. Such high speeds may be achieved by limiting the number of electrically or hydraulically actuated mechanisms in the magazine 10.

In more detail, the magazine 10 includes a plurality of ammunition holders 12 disposed between a pair of opposed walls, namely a first (front) wall 14 and a second (rear) wall 16. Each ammunition holder 12 is configured to operatively interface with a single ammunition round. The ammunition holders 12 are coupled to each other via links 18, with each link 18 connecting an adjacent pair of ammunition holder 12. The ammunition holders 12 may move within the space defined by the first and second walls 14, 16 along a track, with the ammunition holders 12 moving relative to each other in a manner which optimizes firing speed, as well as space. As shown in FIG. 1, the first wall 14 may include an opening 20 formed therein, with the opening 20 being sized to facilitate feeding of a single ammunition round to a gun barrel 22, such as that of a tank. In this regard, each ammunition holder 12 may move along the track with an ammunition round retained within the ammunition holder 12, until the ammunition holder 12 becomes aligned with the opening 20, at which time, the ammunition round may transition from being retained in the ammunition holder 12 to be loaded in the gun barrel 22. The second wall 16 may include an opening(s) for access for loading and unloading ammunition rounds to and from the magazine 10. The opening(s) in the second wall 16 may include a door or other supports to maintain and support the ammunition holders 12 and ammunition rounds between the first and second walls 14, 16.

Figure 2:
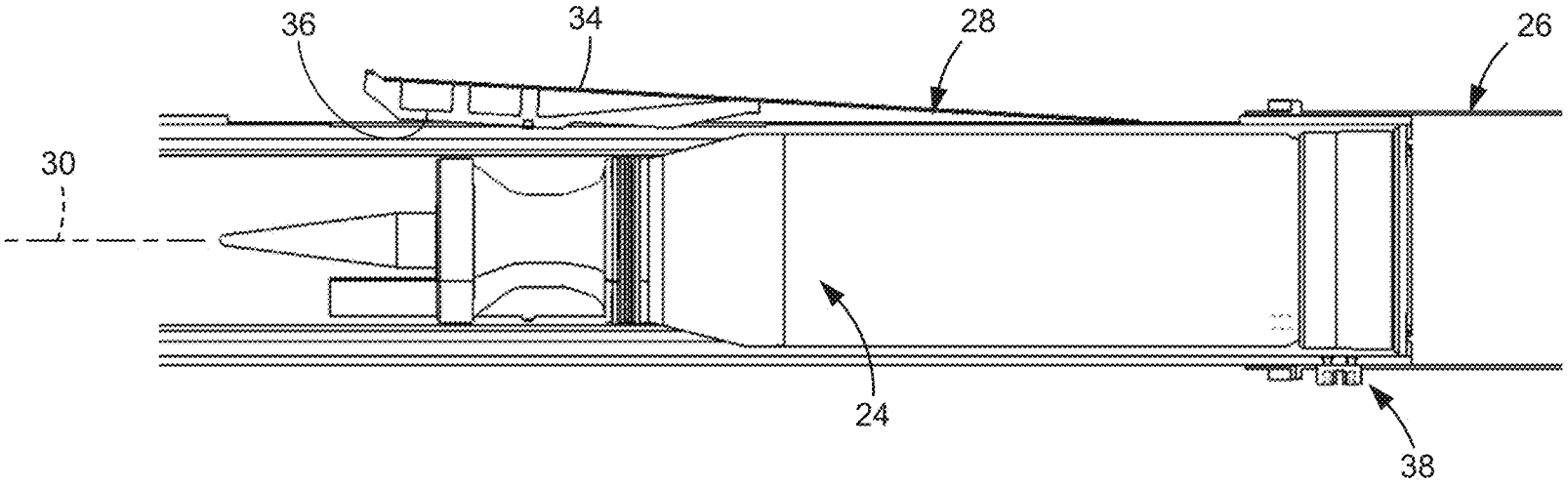
FIG. 2 is a side cross sectional view of an ammunition round and an ammunition holder in the extended position.

Referring now to FIG. 2, there is depicted a cross sectional view showing an ammunition round 24 as it is being transitioned out of the ammunition holder 12 and into the gun barrel 22. FIG. 2 also depicts axial control features of the ammunition holder 12, which allow the ammunition holder 10 to control position of the ammunition round 24 along an axis 30 defined by the ammunition holder 12, as will be described in more detail below.

The ammunition holder 12 includes an outer cylinder (e.g., outer body) 26 and an inner cylinder (e.g., inner body) 28, which is transitional relative to the outer cylinder 26 between a retracted (first) position and an extended (second) position. The axis 30 may be defined by the outer and inner cylinders 26, 28, with both cylinders 26, 28 being disposed about the axis 30. The inner cylinder 28 may translate along the axis 30 relative to outer cylinder 26 as it transitions between the retracted and extended positions. The inner cylinder 28 is configured to extend out of the outer cylinder 26 as the inner cylinder 28 transitions from the retracted position toward the extended position. As noted above, the extension of the inner cylinder 28 out of the outer cylinder 26 may be achieved only when the ammunition holder 12 is aligned with the opening 20 formed in the first wall 14. The ammunition holder 12 may be considered to be aligned with the opening 20 when axis 30 becomes coaxial, or substantially coaxial, with an axis about which the opening 20 is disposed. The first wall 14 may be configured to restrict transition of the inner cylinder 28 from the retracted position toward the extended position to only when the inner cylinder 28 is coaxially aligned with the opening 20.

The inner cylinder 28 may be configured to release the ammunition round 24 in response to the inner cylinder 28 being transitioned to the extended position. According to one embodiment, each inner cylinder 28 may include a main portion 32 and at least one ammunition engagement portion 34 moveable relative to the main portion 32 to facilitate release of the single ammunition round 24. In the exemplary embodiment, each of three ammunition engagement portion 34 is pivotally connected to the main portion 32, and is pivotable between a first position and a second position, and thus, may be connected to the main portion 32 via a hinge or, in the preferred embodiment, a leaf spring. In the first or retracted position, an outer surface of the ammunition engagement portion 34 may be substantially aligned with an outer surface of the main portion 32. In the second or extended position, the outer surface of the main portion 32 may be outward or angled away from the interior of the main portion 32, an example of which is depicted in FIG. 2. A leaf spring may be operatively coupled the ammunition engagement portion 34 to bias the ammunition engagement portion 34 toward the second position (e.g., the leaf spring may bias the ammunition engagement portion 34 outwardly). As shown in FIG. 2, the inner cylinder 28 is extended from the outer cylinder 26 such that the ammunition engagement portions 34 are beyond the constraint of the outer cylinder 26 and thus, the ammunition engagement portions 34 are allowed to be pushed away by the ammunition round 24.

Each ammunition engagement portion 34 may include an inner profile that generally mimics that of the ammunition round 24. The ammunition engagement portion 34 may include an inwardly protruding contact body or lobe 36 that may fit within a channel formed by the ammunition round 24, or alternatively, may fit within space surrounding a tapered tip of the ammunition round 24. The purpose of the lobe 36 is to restrain the ammunition round 24 from forward movement when the inner cylinder 28 is retracted within the outer cylinder 26. When the ammunition round 24 is advanced forwardly, the outer diameter of the ammunition round 24 along a main shaft thereof may interface with the contact body 36 to push the contact body outwardly, thereby allowing the round 24 to move forward.

Figure 2A:
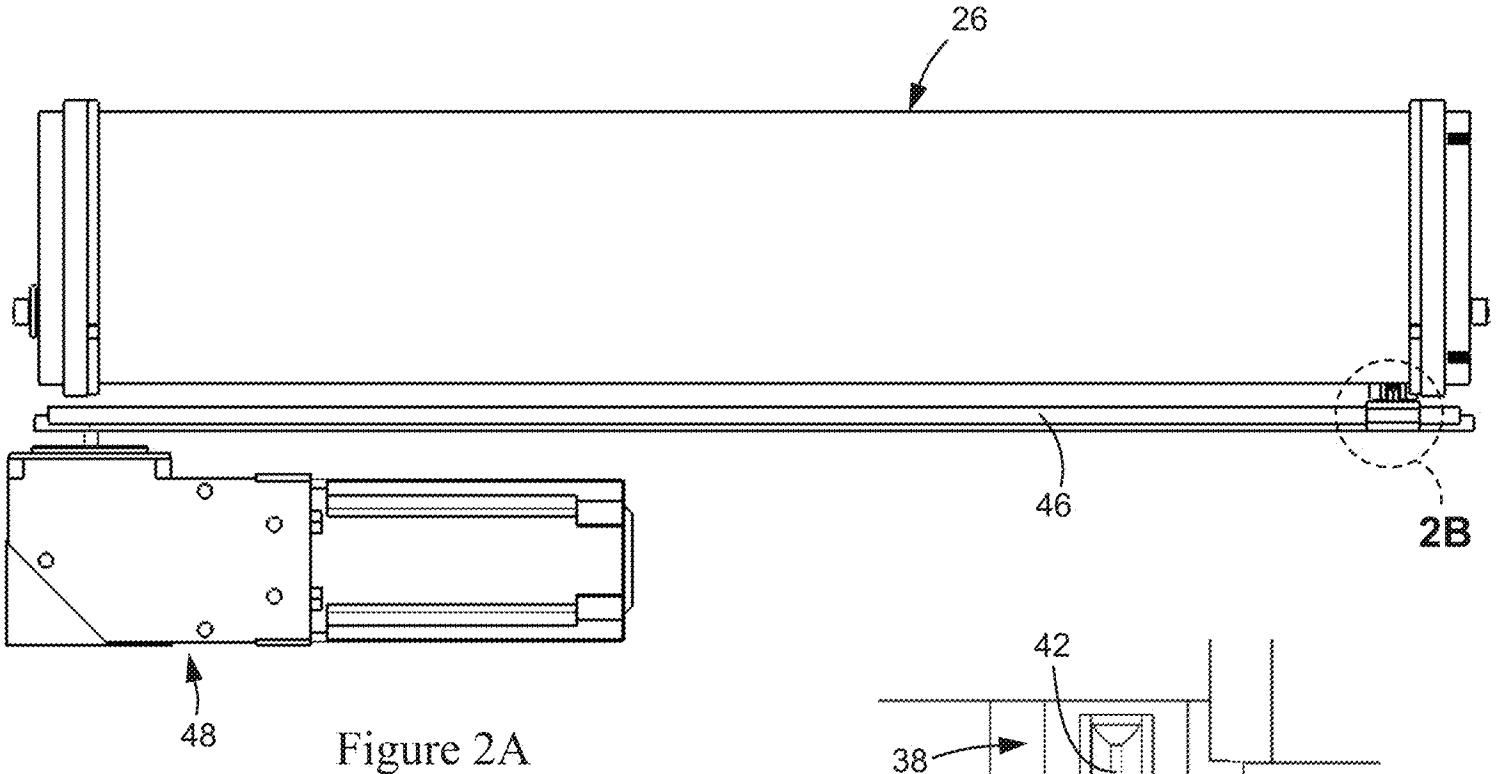
FIG. 2A is a side view of a motor for controlling position of a carriage coupled to an inner tube for controlling position of the inner tube relative to the outer tube.
Figure 2B:
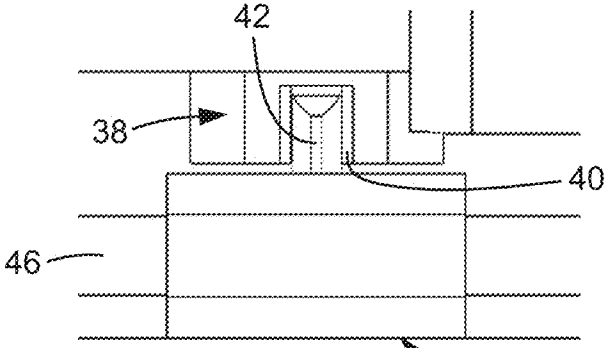
FIG. 2B is an enlarged view depicted an axial control body.

According to one embodiment, and referring now specifically to FIGS. 2A and 2B, axial positioning of the inner cylinder 28 relative to the outer cylinder 26 may be facilitated by an axial control body 38 on the inner cylinder 28 which extends through the outer cylinder 26 and is configured to facilitate control of the location of the inner cylinder 28 within the outer cylinder 26. The axial control body 38 may include a groove or recess 40 sized to receive a post 42 or other projecting feature coupled to a carriage 44, which may be translatably coupled to one or more rails 46. A motor 48 may drive the carriage 44 on the rails 46 forward and aft via a belt or chain operatively connecting the motor 48 to the carriage 44. The carriage 44 may be designed to allow the magazine 10 to cycle and once an inner cylinder 28 is aligned to the gun barrel 22, the carriage 44 may drive the axial control body 38 on that inner cylinder 28 forward and aft.

Figure 3:
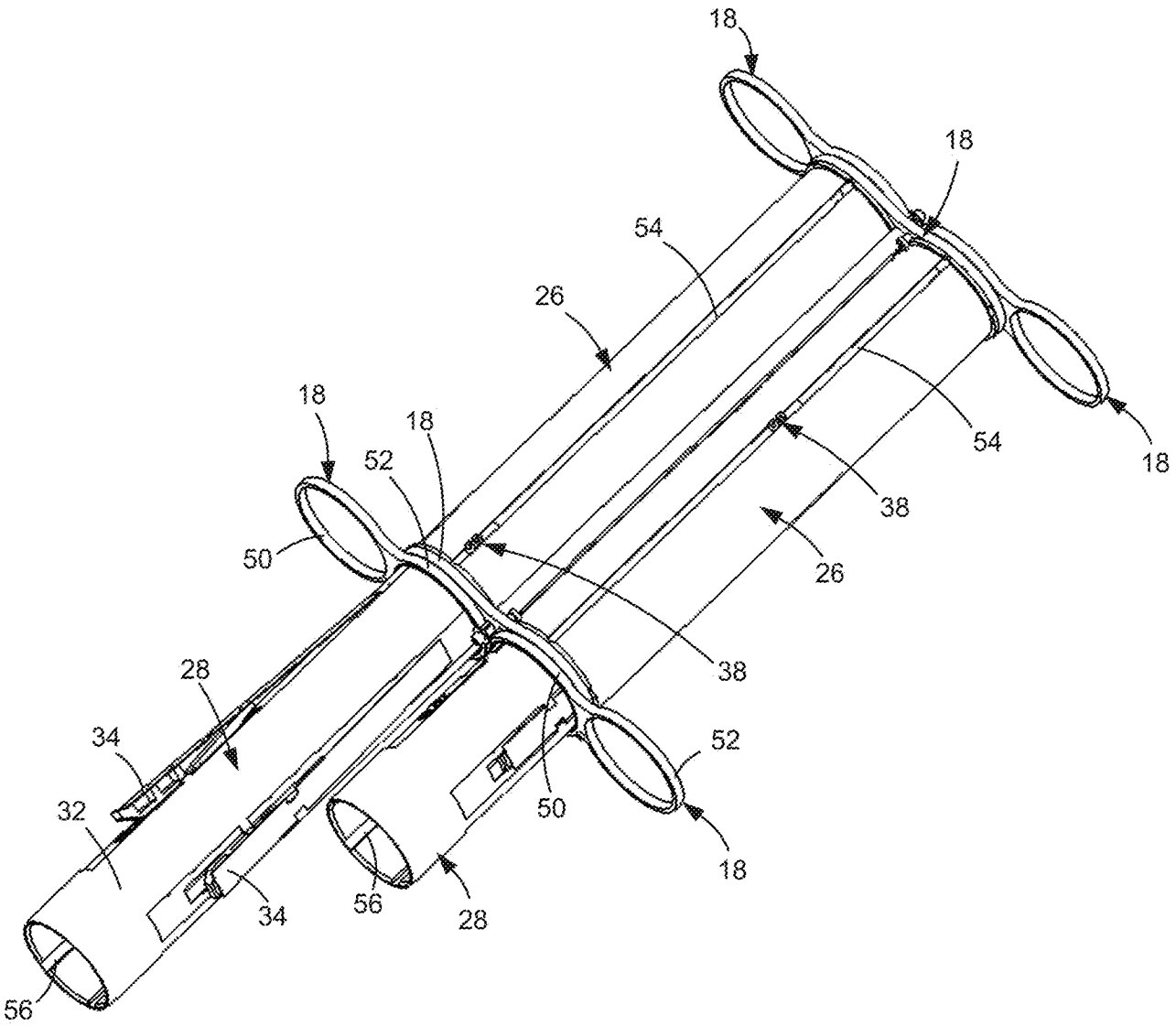
FIG. 3 is an upper perspective view of a pair of ammunition holders operatively connected via a link, with each of the ammunition holders being at different stages of transition between a retracted position and the extended position.

Referring now to FIG. 3, as noted above, the magazine 10 may additionally include a plurality of links 18, with each link 18 being coupled to a pair of the plurality of ammunition holders 12. Each link 18 may include a first rim 50 defining a first opening sized to receive a first ammunition holder 12, and a second rim 52 coupled to the first rim 50 and defining a second opening sized to receive a second ammunition holders 12. A given ammunition holder 12 may be operatively connected to one adjacent ammunition holder 12 via a first link 18 and another adjacent ammunition holder 12 via a second link 18.

FIG. 3 depicts an example of how the outer cylinders 26 may be connected by links 18 such that they can form a chain-like loop. In particular, each outer cylinder 26 may be connected to two links 18, with one of the links 18 also being connected to an adjacent outer cylinder 26 on a first side, and the other link 18 being connected to an adjacent outer cylinder on an opposite second side. The links 18 can be made to hold more than two outer cylinders 26. However, the significance of only holding two is that the outer cylinders 26 may be folded or otherwise transitioned into a "zig-zag" configuration (as described in more detail below) in a minimal space, which is an advantage of this particular type of magazine 10.

The axial control body 38 for the inner cylinder 28 can also be seen in FIG. 3, as well as the retention of the axial control body 38 within the outer cylinder 26 when the inner cylinder 28 is inside the outer cylinder 26. As shown in the two positions of extension of the inner cylinder 28, the axial control body 38 is free to move in an axial direction but is otherwise captured within elongate grooves 54 extending lengthwise within the outer cylinders 26. Internal lengthwise cuts, grooves or channels 56 located in inner cylinders 28 are also shown, the purpose of which will be described in more detail below.

Figure 5A:
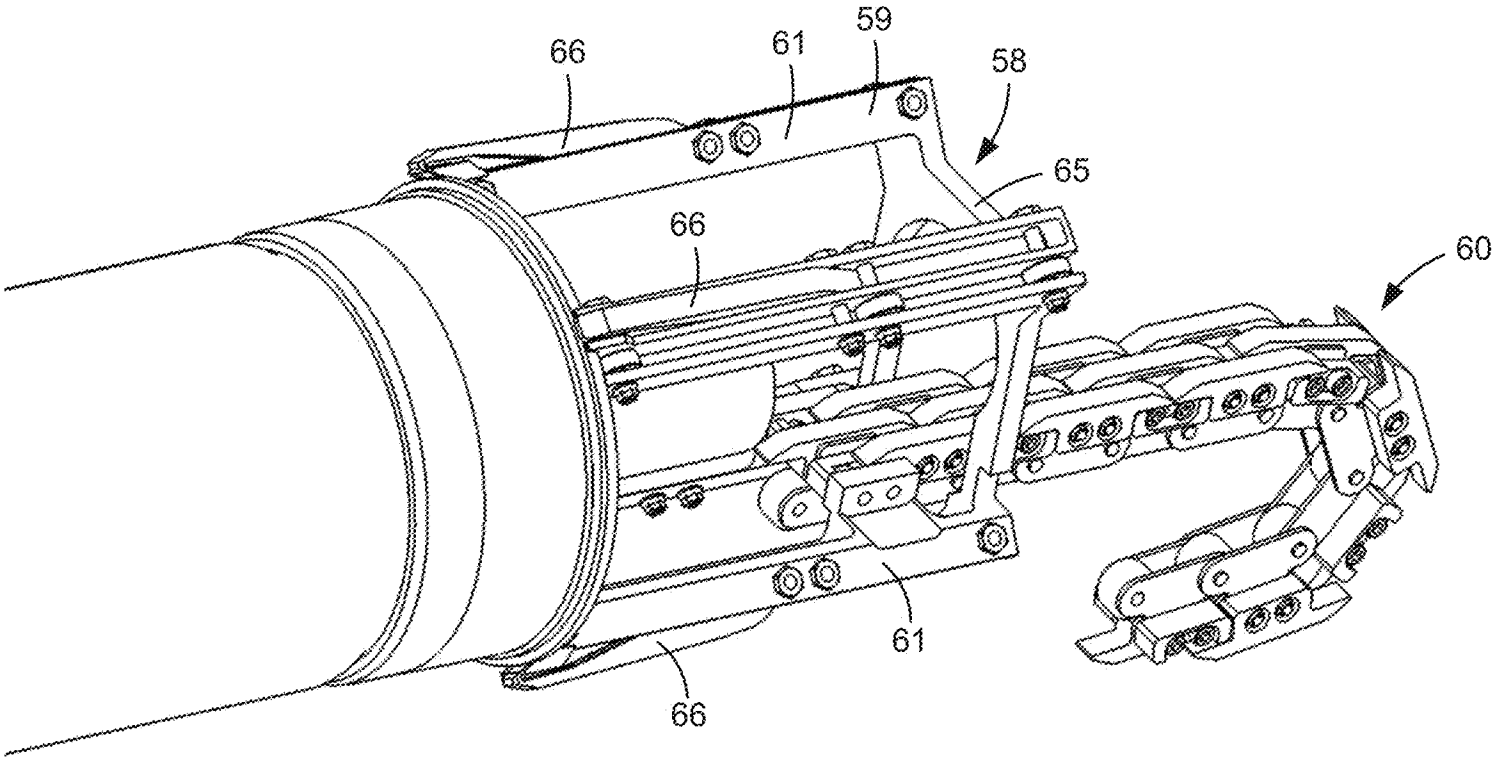
FIG. 5A is an upper perspective view of a rammer head coupled to the strong-back chain and interfacing with an ammunition round.
Figure 5B:
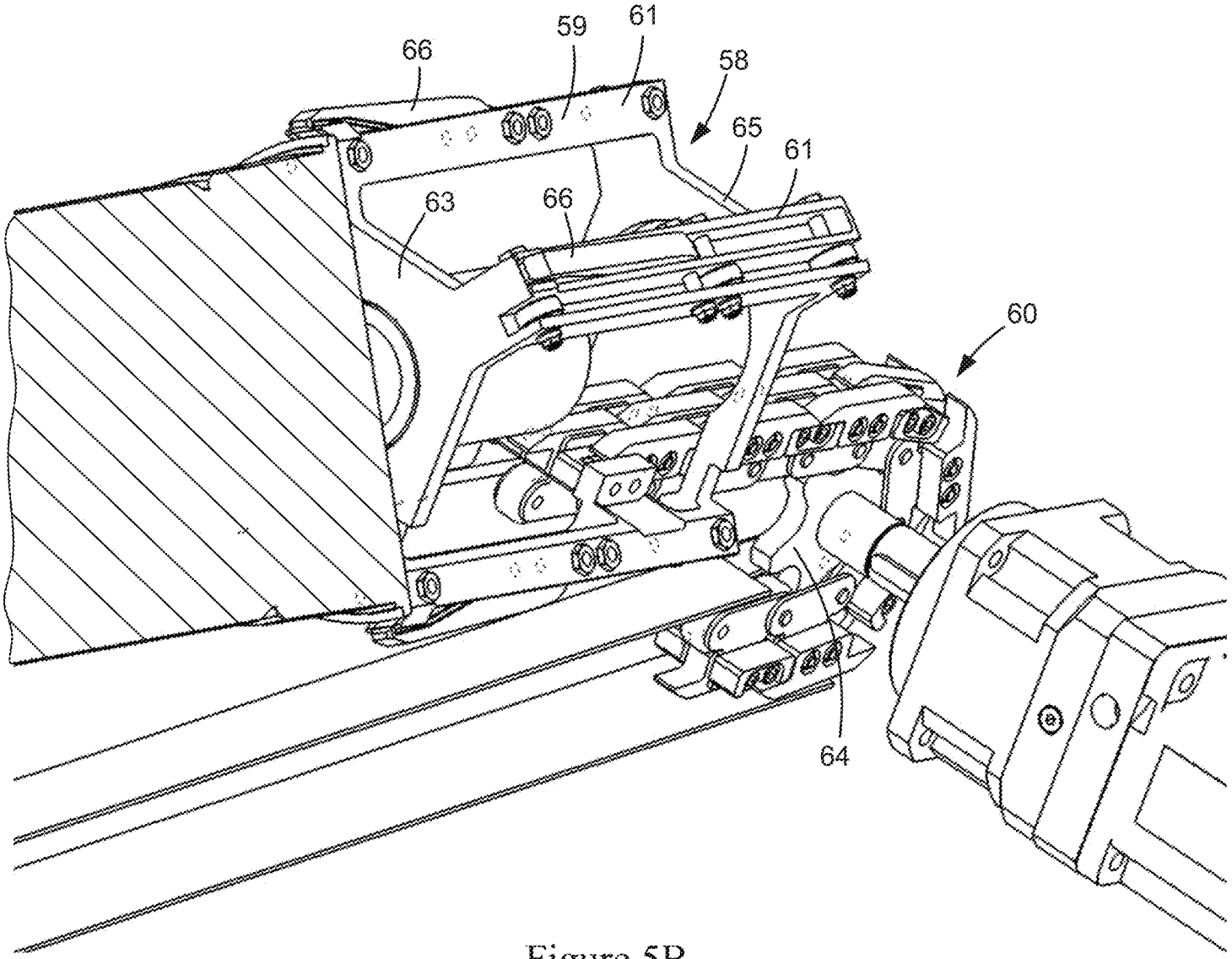
FIG. 5B is an upper perspective view of a drive sprocket operatively coupled to the strong-back chain for controlling position of the strong-back chain, with a portion of the ammunition round being cutaway to depict a front wall of the rammer head.
Figure 5C:
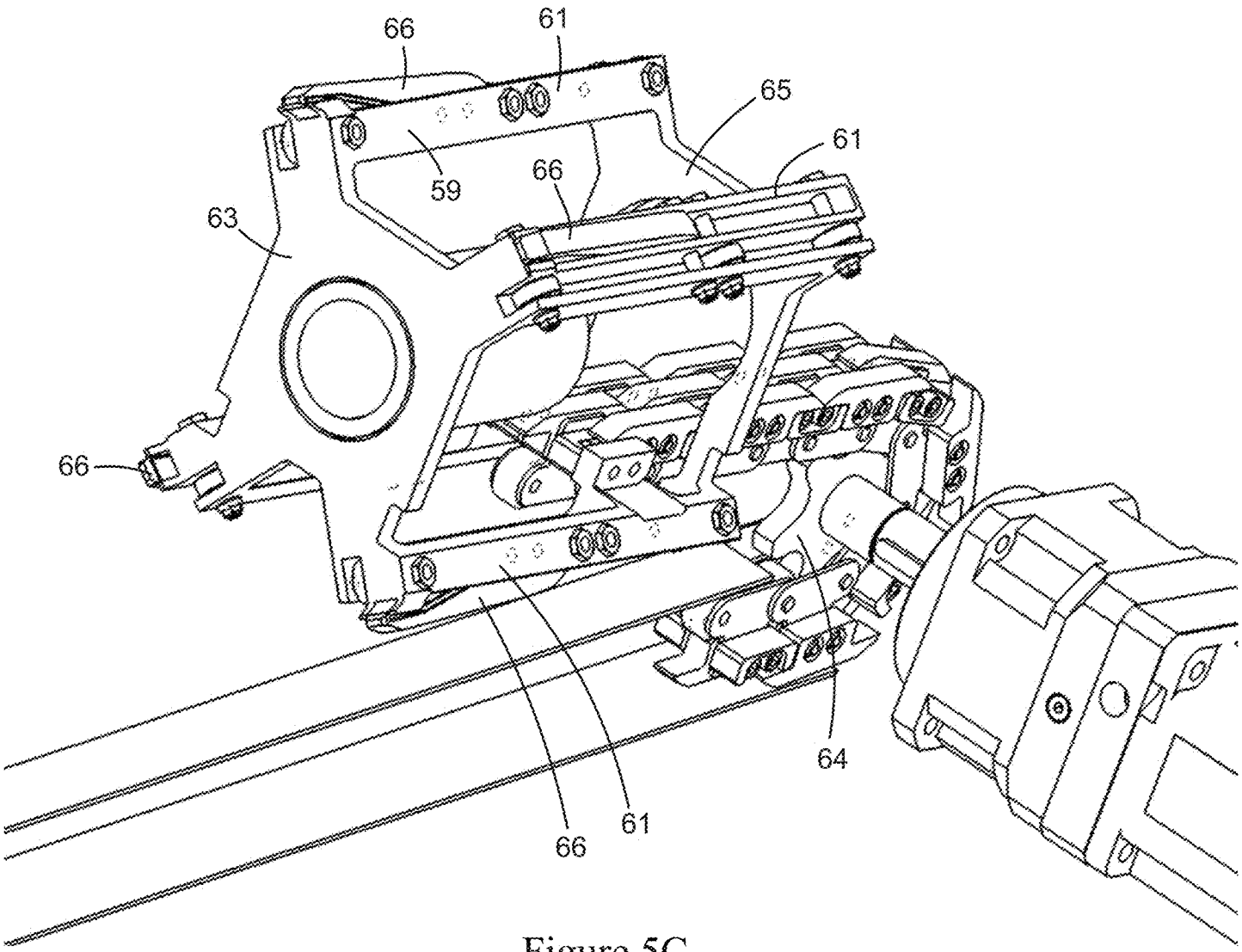
FIG. 5C is an upper perspective view of the rammer head and drive sprocket of FIG. 5B, with the ammunition round being removed to more clearly depict the rammer head.
Figure 5D:
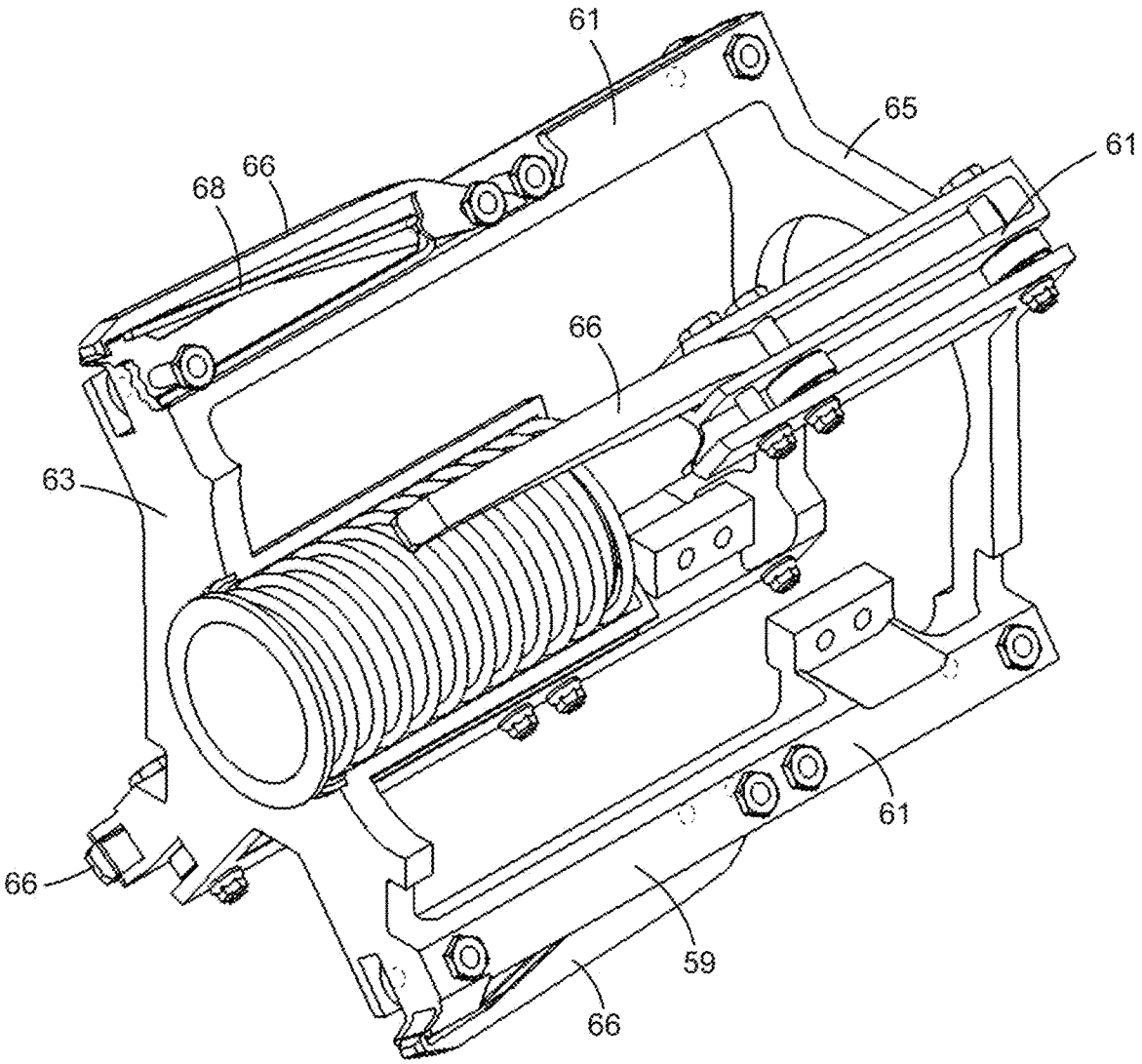
FIG. 5D is an upper perspective view of the rammer head.
Figure 6:
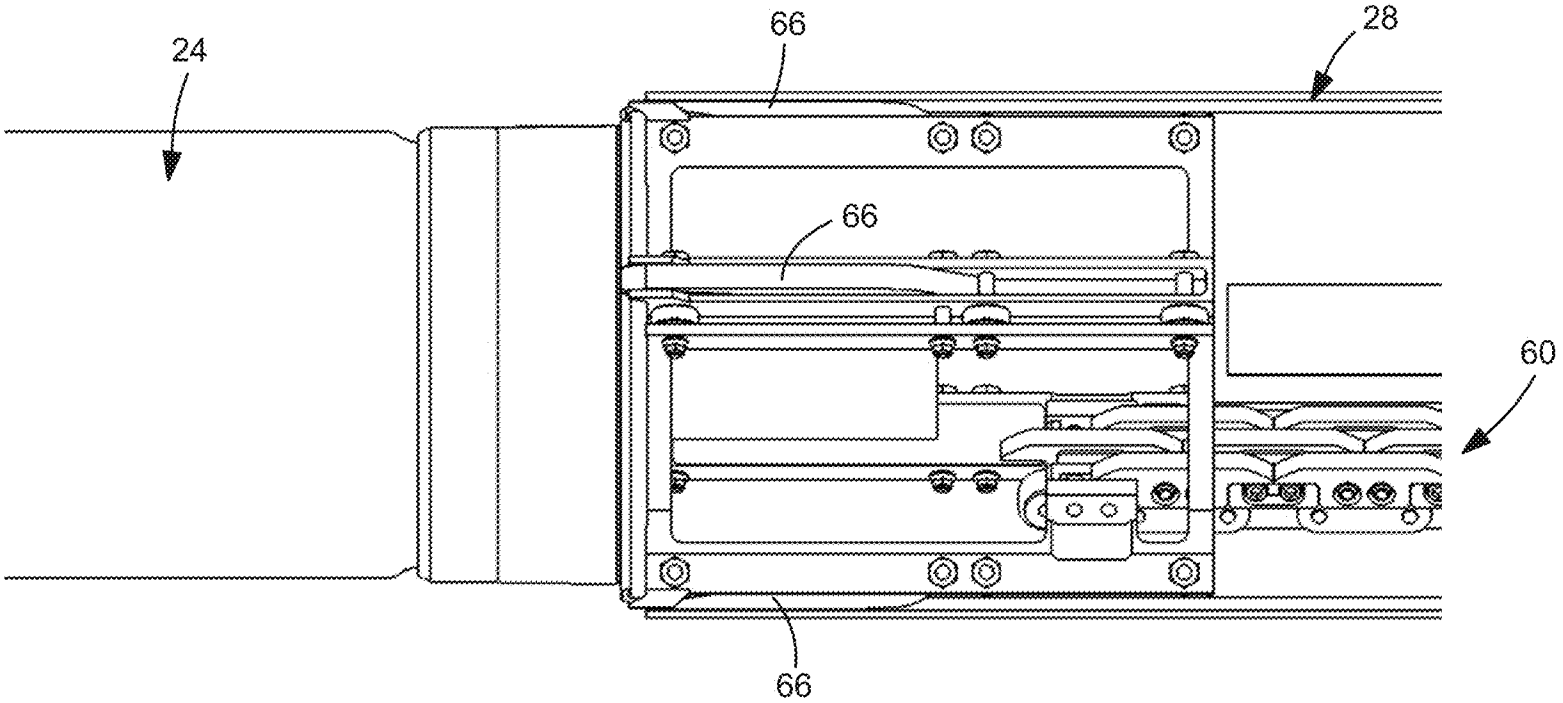
FIG. 6 is a side view of the rammer head contacting an end of an ammunition round.

Referring now to FIGS. 4-6, the magazine 10 may also comprise a rammer head 58 to facilitate pushing of the ammunition round 24 out of the ammunition holder 12 and into the gun barrel 22. The rammer head 58 may be moveable relative to the plurality of ammunition holders 12 between a retracted position and an extended position. The magazine 12 may also include a strong-back chain 60 coupled to the rammer head 58 to facilitate positional control over the rammer head 58.

Figure 4A:
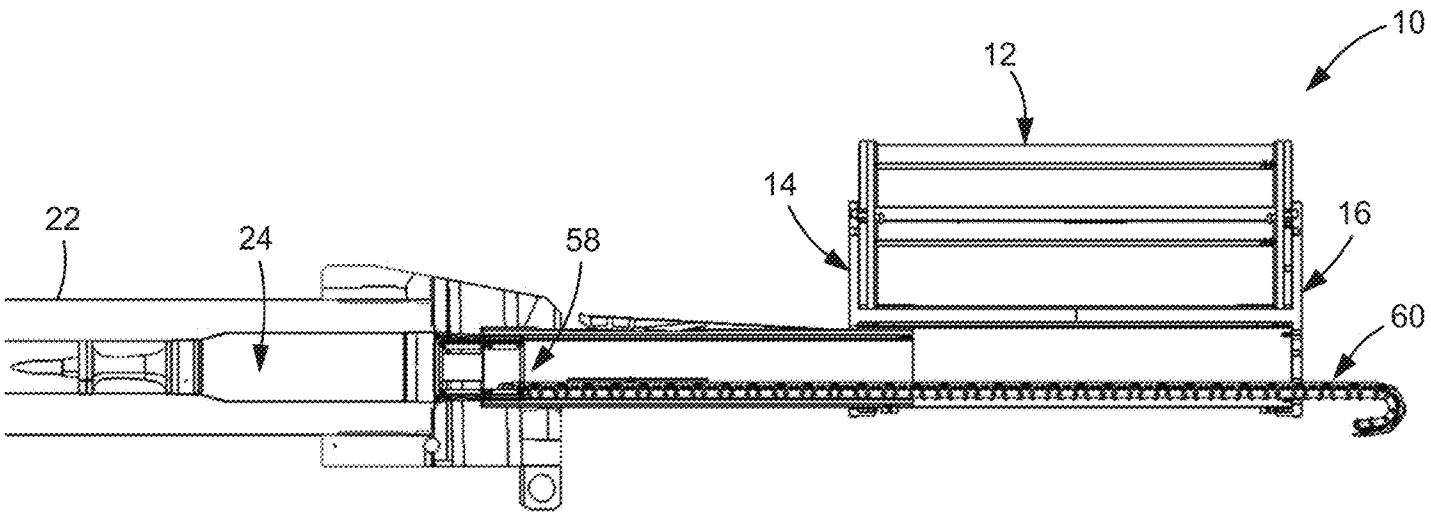
FIG. 4A is a side, cross sectional view of an ammunition round being loaded into a gun barrel by a rammer head connected to a strong-back chain.
Figure 4B:
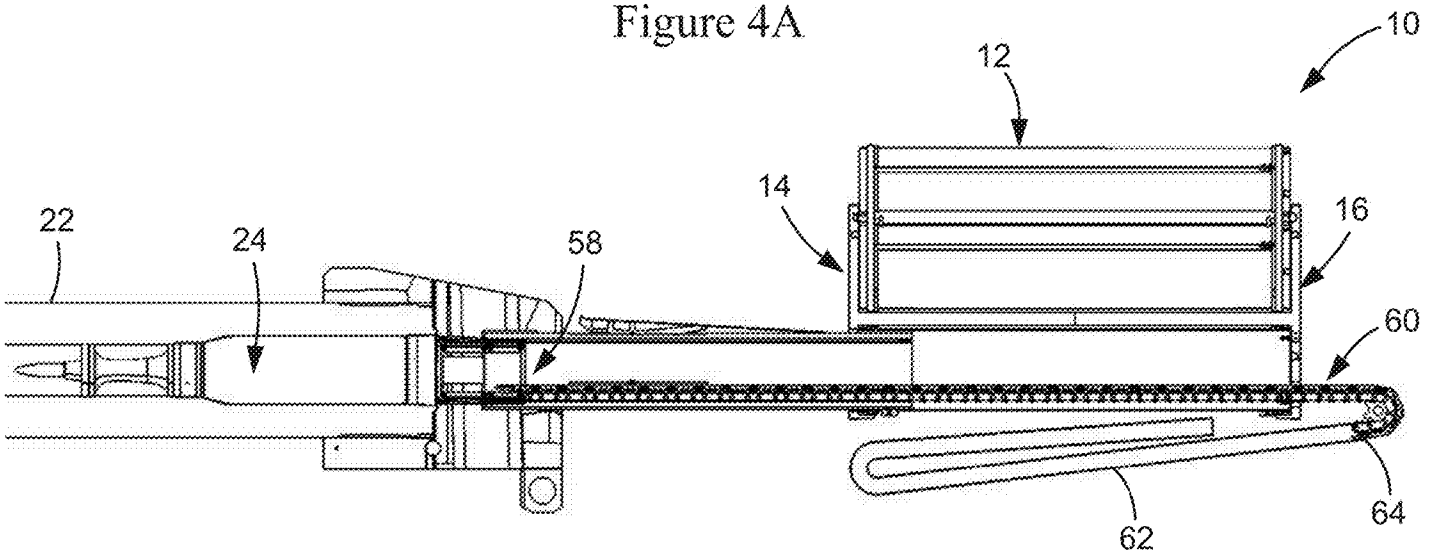
FIG. 4B is a side, cross sectional view showing a guide track for the strong-back chain.

FIGS. 4A and 4B show an ammunition round 24 loaded into the main gun barrel 22 by the rammer head 58 connected to strong-back chain 60. The inner cylinder 28 provides the guidance and support to align the ammunition round 24 to the gun barrel 22. The strong-back chain 60, as shown in FIGS. 4A and 4B, is fully extended, and may be transitioned from the fully extended position to a fully retracted position, wherein most, if not all, of the strong-back chain 60 is stored in a housing 62 or guide rack underneath the ammunition holders 12. The strong-back chain 60 may include additional pieces added onto a standard chain to make it bend in only one direction and not the other. The strong-back chain 60 may be driven by a sprocket 64 at the rear end of the magazine 10 from the perspective shown in FIGS. 4A and 4B.

The movement of the rammer head 58 may be separate from movement of the inner cylinder 28. Thus, the rammer head 58 may move relative to the inner cylinder 28. As noted above, control of rammer head movement is facilitated by the strong-back chain 60, while movement of the inner cylinder 28 may be facilitated by the carriage 44; thus, movement of the strong-back chain 60 may be independent of movement of the carriage 44.

FIG. 5A shows the rammer head 58 connected to the strong-back chain 60. The back wall 16 of the magazine 10 may be configured so as not to impede the motion of the rammer head 58 while also being configured to retain the inner cylinder 28 and the ammunition round 24 within the magazine 10. The front of the rammer head 58 is shown in contact with the base end of the ammunition round 24. The rammer head 58 may be configured to simply push against the base end of the ammunition round 24 as the strong-back chain 60 is extended until the ammunition round 24 is seated or received in the gun barrel 22.

The rammer head 58 may include a rammer head frame 59 having a plurality of longitudinal supports 61 extending between opposing front and rear frame walls 63, 65. The rammer head 58 may further include a plurality of gripping fingers 66, with each gripping finger being pivotally connected to a corresponding finger supports 61. The strong-back chain 60 being coupled to the rear frame wall 65 via mechanical fasteners. The rammer head frame 59 may have a generally hollow interior or void to minimize weight.

The gripping fingers 66 may be spring loaded open and away from the base of the ammunition round 24 such that there is limited axial control. A leaf spring 68 may be used to impart the spring-biased force on the gripping fingers 66 to facilitate disengagement of the gripping fingers 66 from the ammunition round 24 during removal of the ammunition round 24 from the magazine 10.

FIG. 6 depicts an example of how the gripping fingers 66 may have control of the ammunition round 24. As long as the rammer head 58 is located inside the inner cylinder 28, the cuts 56 on the inner cylinder 28 may hold down the gripping fingers 66 such that the ammunition round 24 is under complete control by the strong-back chain 60. As noted above, the strong-back chain 60 and the inner cylinder 28 may be driven independently. When an inner cylinder 28 is at the opening 20 in the magazine 10, the groove 40 in the axial control body 38 of the inner cylinder 28 can interface with the carriage 44 to maintain axial control of the inner cylinder 28. This may be necessary as the walls 14, 16 may provide limited support to the inner cylinder 28 once the inner cylinder 28 extends through opening 20. This complete control allows a "soft" load into the gun barrel 22 and may also provide the option to remove the ammunition round 24 from the gun barrel 22 if so desired since the strong-back chain 60 may also pull on the ammunition round 24 (in addition to pushing on the ammunition round 24). The added advantage of the strong-back chain 60 and the inner cylinder 28 being driven independently is that they can be driven concurrently with different start/stop times and start/stop positions. Having the ability to be driven simultaneously as opposed to sequentially reduces the actuation time, thus increases firing rate. Importantly, independent control of the axial position of the rammer head 58 and the inner cylinder 28 provides control of the position of fingers 66. To open the fingers 66 the inner cylinder is retracted relative to the rammer head 58 thus allowing the fingers 66 to spring open releasing the round 24. To close the fingers 66 and capture the round 24, the inner cylinder 28 is extended relative to the rammer head 58 wherein the lip of the inner cylinder 28 cams the fingers 66 to the closed position, thereby capturing the round 24.

A rammer head home position may be at the rear end of the magazine 10 outside of the cylinders 26, 28 and the gripping finger 66 on the rammer head 58 may be spring loaded open. As the rammer head 58 moves forward into the inner cylinder 28, the inner cylinder 28 may push or urge the fingers 66 closed around the lip at the base end of the ammunition round 24. FIG. 6 shows the fingers 66 in the inner cylinder 28 and the gripping fingers 66 in the closed position around the lip at the base end of the ammunition round 24 so that the ammunition round 24 stays with the rammer head 58 throughout the entire motion of the ammunition round 24 being loaded from the magazine 10 into the gun barrel 22. FIGS. 4A and 4B shows the rammer head 58 fully extended. The gripping fingers 66 are outside of the inner cylinder 28 so the fingers 66 spring open allowing the ammunition round to be left at the loaded position in the gun barrel 22 as the rammer head 58 and inner cylinder 28 retract. The rammer head 58 passes back through the inner cylinder 28 during the retract motion to the rammer head home position at the rear of the magazine 10. The gripping fingers 66 will close as they pass back through the inner cylinder 28 and then spring open as the gripping fingers 66 exit the inner cylinder 28 at the rear of the magazine 10.

Figure 7:
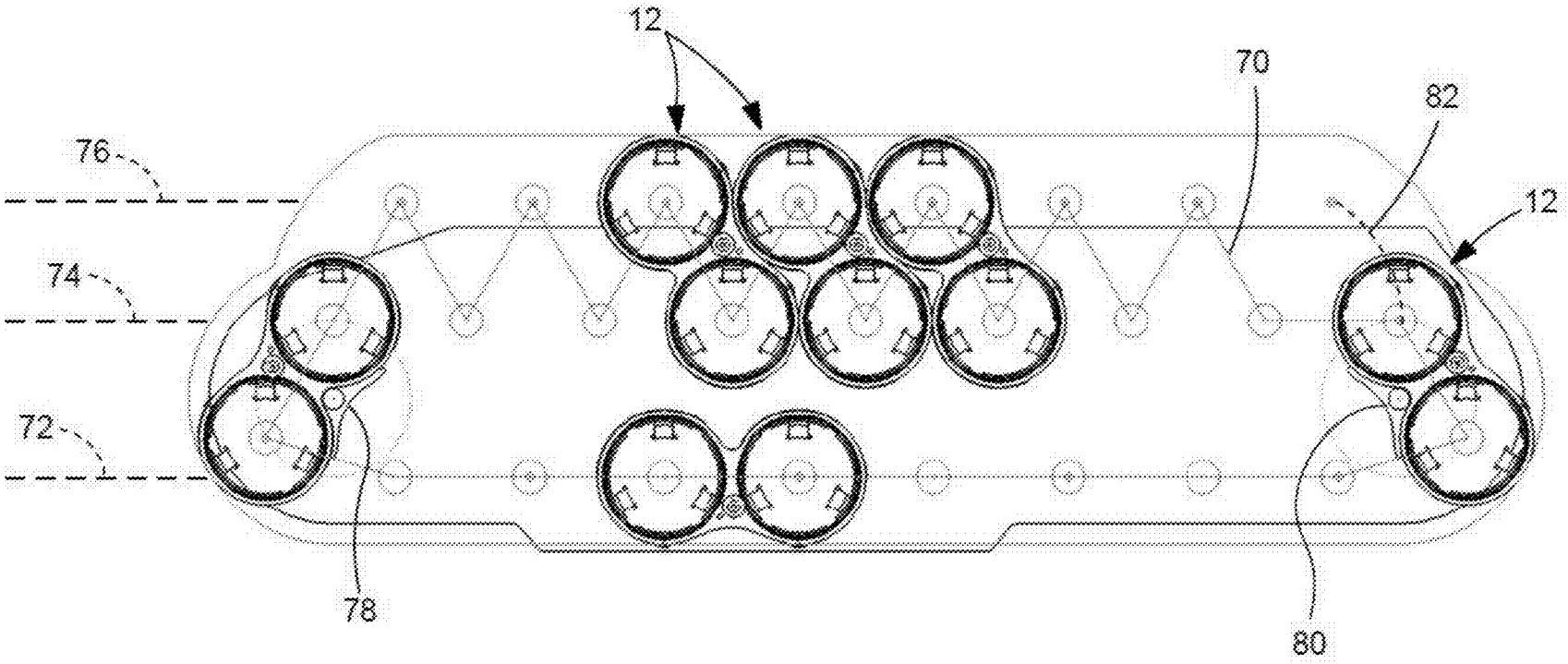
FIG. 7 is a front view of a schematic depicting the configuration of pairs of ammunition holders as they traverse within the magazine, with a top row of tubes showing a zig-zag, folded configuration of the tube pairs.
Figure 8:
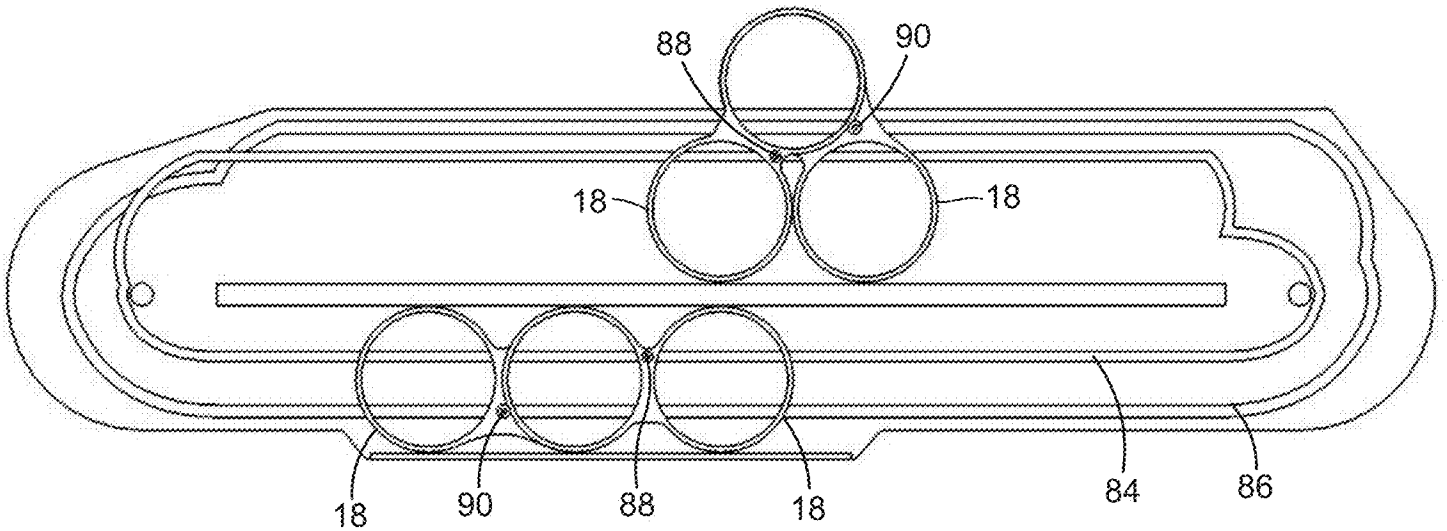
FIG. 8 is a front view of four tube connecting links, with cam paths being shown in the front and back walls guiding cam followers on connecting links to direct the folding and unfolding of the ammunition storage tubes.

Referring now specifically to FIGS. 7 and 8, the ammunition holders 12 may move within the magazine 10 along a track 70 configured to optimize space and speed in operating the magazine 10. FIG. 7 shows the magazine 10 inclusive of a total of twenty-six (26) ammunition holders 12. The quantity of ammunition holders 12 may be an even number which may allow for a simpler method of controlling the folding pattern of the ammunition holders 12. When the height of the storage volume allows for an even number of rows of ammunition rounds 24, such as two or four, a simple "chain" loop will work. In some instances, there is height for three rows but not four. A folded "zig-zag" loop allows for three row storage. In the folded "zig-zag" portion of the moving ammunition holders 12, every other ammunition holder 12 is on the upper or lower portion of the "zig-zag". With an even number of ammunition holders 12, an ammunition holder 12 will stay on the top of the fold or the bottom of the fold when folded regardless of the direction or the number of times the chain loop cycles. Whereas, with an odd number of ammunition holders 12, an ammunition holder 12 may be on the top of the fold one time, and depending on the how the chain loop cycles, the same ammunition holder 12 may end up on the bottom.

In this regard, according to one embodiment, the plurality of ammunition holders 12 may be configured to be disposable along at least three parallel axes 72, 74, 76. The plurality of ammunition holders 12 are operatively linked to each other such that a first group of the plurality of ammunition holders 12 reside on a first axis 72, a second group of the plurality of ammunition holders 12 reside on a second axis 74, and a third group of the plurality of ammunition holders 12 reside on a third axis 76. At any given time, additional ammunition holders 12 may reside between the first, second and third axis 72, 74, 76.

The plurality of ammunition holders 12 may be configured such that a given pair of ammunition holders 12 are operatively linked to each other such that they are both aligned with the first axis 72 during a portion of the movement of the pair along the magazine track 70. The track 70 may be configured such that movement of the pair along the first axis 72 is translation-type movement.

The given pair of ammunition holders 12 may be operatively linked to each other such that as the holders transition around the track 70, one of the pair of ammunition holders 12 resides on the second axis 74 while the other of the pair resides on the third axis 76. One of the pair of ammunition holders 12 may translate along the second axis 74 while the other of the pair of ammunition holders 12 may translate along the third axis 76.

While the straight cylinder path at the very bottom of the magazine 10 may be driven to move continuously, the top folded part of the ammunition holders 12 may move in an intermittent fashion. In the schematic as shown in FIG. 7, if the straight cylinder path on the bottom of the loop is moving to the right, the drive sprockets 78, 80, on the left and right ends of the schematic will be rotating counter-clockwise. At the top of the right side drive sprocket 80, the ammunition holder 12 on top of the drive sprocket 80 will move in a curve manner following the dash line 82 as it starts folding to "zig-zag" position. As this ammunition holder 12 is folding, the bulk of the folded ammunition holders 12 on the top of the schematic remain stationary. Simultaneously, the left side drive sprocket 78 is still rotating counter-clockwise. But the bulk of the folded cylinders are not moving. In order to accommodate the left side drive sprocket 78 rotating, the very first set of ammunition holders 12 on the left side just above the left side drive sprocket 78 is unfolding from the "zig-zag" position to a linear position. This unfolding allows the left drive sprocket 78 to continue to rotate without the bulk of the folded or "zig-zag" ammunition holder 12 moving at all. At the moment that the left side ammunition holder 12 is unfolded, the geometry is such that the right side folding ammunition holder 12 is completely folded. At that moment, the right side drive sprocket 80 will then push the folded ammunition holders 12 to the left until the ammunition holders 12 move one pitch distance, at which point, the folding and unfolding can repeat itself. This allows the straight portion of the ammunition holders 12 on the very bottom to cycle while the top folded ammunition holders 12 move intermittently. This same action can go in the clockwise and counter-clockwise direction thus providing the magazine 10 to cycle ammunition in either direction to the proper selection of ammunition type in the event different types of rounds are loaded.

FIG. 8 shows the cam tracks 84, 86 and the cam followers 88, 90 coupled to the links 18 that controls the folding and unfolding of the ammunition holders 12. The cam tracks 84, 86 may be present on the inward face of the front wall 14 and mirror image cam tracks 84, 86 may be coupled to the inward face of the rear wall 16. Larger diameter cam followers run in the wider cam tracks. Smaller diameter cam followers run in a narrower but longer cam track. The distinction between the lengths and diameters of the cam tracks and cam followers will prevent the cam followers from going into the incorrect cam track whenever the two cam tracks cross over each other.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A magazine for ammunition, the magazine comprising:

a first magazine cam track;

a second magazine cam track in spaced relation to the first magazine cam track;

a plurality of ammunition holders coupled to the first and second magazine cam tracks, each ammunition holder being configured to operatively interface with a single round of ammunition, the plurality of ammunition holders being configured such that separate portions of the plurality of ammunition holders are concurrently positionable along respective first, second, and third axes, ammunition holders positioned along the first axis defining a linear portion of the magazine in which the ammunition holders are aligned along the first axis, and ammunition holders positioned along the second and third axes defining a folded zig-zag portion of the magazine in which every other ammunition holder is on an upper or lower portion of the folded zig-zag, each ammunition holder being configured to enable an ammunition round to be advanceable therethrough;

a plurality of links, each link being connected to an adjacent pair of the plurality of ammunition holders; and a plurality of cam followers coupled to the plurality of links and configured to facilitate movement of the plurality of ammunition holders along the first magazine cam track and the second magazine cam track, the first magazine cam track and the second magazine cam track being configured to facilitate movement of a given adjacent pair of the plurality of ammunition holders from both being positioned along the first axis in the linear portion to one of the given adjacent pair being positioned along the second axis and the other of the given adjacent pair being positioned along the third axis in the folded zig-zag portion.

2. The magazine recited in claim 1, wherein the plurality of cam followers include a first set of cam followers associated with the first magazine cam track and a second set of cam followers associated with the second magazine cam track, the first set of cam followers being affixed to every other one of the plurality of links, and the second set of cam followers being affixed to the remaining ones of the plurality of links.

3. The magazine recited in claim 2, wherein the first set of cam followers are offset from the second set of cam followers to facilitate engagement with the first magazine cam track and the second magazine cam track, respectively.

4. The magazine recited in claim 2, wherein each of the first set of cam followers is associated with a first diameter and each of the second set of cam followers is associated with a second diameter different from the first diameter.

5. The magazine recited in claim 4, wherein the first magazine cam track, the second magazine cam track, and the plurality of cam followers are configured such that the first set of cam followers can only move within the first magazine cam track and the second set of cam followers can only move within the second magazine cam track.

6. The magazine recited in claim 1, wherein the first magazine cam track and the second magazine cam track are configured so as not to cross each other.

7. The magazine recited in claim 1, wherein the first magazine cam track and the second magazine cam track are configured to facilitate movement of the plurality of ammunition holders such that a given adjacent pair of the plurality of ammunition holders proceed from one of the pair residing along the second axis and the other of the pair residing along the third axis to both residing on the first axis.

8. The magazine recited in claim 1, wherein the first magazine cam track intersects the second magazine cam track.

9. The magazine recited in claim 1, further comprising a rammer head moveable relative to the plurality of ammunition holders between a retracted position and an actuated position.

10. The magazine recited in claim 1, wherein each ammunition holder includes:

an outer body; and an inner body configured to interface with the single round of ammunition;

wherein each inner body includes a main portion and at least one ammunition engagement portion moveable relative to the main portion to facilitate release of the single round of ammunition;

wherein each ammunition holder further comprises a leaf spring operatively coupled to a corresponding one of the at least one ammunition engagement portion to bias the at least one ammunition engagement portion in a prescribed direction.

11. A magazine for ammunition, the magazine comprising:

a first magazine cam track;

a second magazine cam track in spaced relation to the first magazine cam track;

a plurality of ammunition holders coupled to the first and second magazine cam tracks, the plurality of ammunition holders being configured such that separate portions of the plurality of ammunition holders are concurrently positionable along respective first, second, and third axes, ammunition holders positioned along the first axis defining a linear portion of the magazine in which the ammunition holders are aligned along the first axis of the magazine, and ammunition holders positioned along the second and third axes defining a folded zig-zag portion of the magazine in which every other ammunition holder is on an upper or lower portion of the folded zig-zag, each ammunition holder being configured to enable an ammunition round to be advanceable therethrough;

a plurality of links, each link being connected to an adjacent pair of the plurality of ammunition holders; and a plurality of cam followers coupled to the plurality of links and configured to facilitate movement of the plurality of ammunition holders along the first magazine cam track and the second magazine cam track, the first magazine cam track and the second magazine cam track being configured to facilitate movement of a given adjacent pair of the plurality of ammunition holders from both being positioned along the first axis in the linear portion to one of the given adjacent pair being positioned along the second axis and the other of the given adjacent pair being positioned along the third axis in the folded zig-zag portion.

12. The magazine recited in claim 11, wherein the plurality of cam followers include a first set of cam followers associated with the first magazine cam track and a second set of cam followers associated with the second magazine cam track, the first set of cam followers being affixed to every other one of the plurality of links, and the second set of cam followers being affixed to the remaining ones of the plurality of links.

13. The magazine recited in claim 12, wherein the first set of cam followers are offset from the second set of cam followers to facilitate engagement with the first magazine cam track and the second magazine cam track, respectively.

14. The magazine recited in claim 12, wherein each of the first set of cam followers is associated with a first diameter and each of the second set of cam followers is associated with a second diameter different from the first diameter.

15. The magazine recited in claim 14, wherein the first magazine cam track, the second magazine cam track, and the plurality of cam followers are configured such that the first set of cam followers can only move within the first magazine cam track and the second set of cam followers can only move within the second magazine cam track.

16. The magazine recited in claim 11, wherein the first magazine cam track and the second magazine cam track are configured so as not to cross each other.

17. The magazine recited in claim 11, wherein the first magazine cam track and the second magazine cam track are configured to facilitate movement of the plurality of ammunition holders such that a given adjacent pair of the plurality of ammunition holders proceed from one of the pair residing along the second axis and the other of the pair residing along the third axis to both residing on the first axis.

18. The magazine recited in claim 11, wherein the first magazine cam track intersects the second magazine cam track.

19. The magazine recited in claim 11, wherein movement of the given adjacent pair along the first axis is translation-type movement, and wherein, when the given adjacent pair is positioned in the folded zig-zag portion, one ammunition holder of the given adjacent pair is configured to translate along the second axis while the other ammunition holder of the given adjacent pair is configured to translate along the third axis.

20. A magazine for ammunition, the magazine comprising:

a first magazine cam track;

a second magazine cam track in spaced relation to the first magazine cam track;

a plurality of ammunition holders coupled to the first and second magazine cam tracks, the plurality of ammunition holders being configured such that separate portions of the plurality of ammunition holders are concurrently positionable along respective first, second, and third axes, each ammunition holder being configured to enable an ammunition round to be advanceable therethrough;

a plurality of links, each link being connected to an adjacent pair of the plurality of ammunition holders;

a plurality of cam followers coupled to the plurality of links and configured to facilitate movement of the plurality of ammunition holders along the first magazine cam track and the second magazine cam track; and wherein the first magazine cam track intersects the second magazine cam track.

* * * * *